US009033194B1

(12) United States Patent
Grabowski et al.

(10) Patent No.: US 9,033,194 B1
(45) Date of Patent: May 19, 2015

(54) DISPENSING APPARATUS

(71) Applicants: Al Grabowski, Paradise Valley, AZ (US); James Kusbel, Scottsdale, AZ (US)

(72) Inventors: Al Grabowski, Paradise Valley, AZ (US); James Kusbel, Scottsdale, AZ (US)

( * ) Notice: Subject to any disclaimer, the term of this patent is extended or adjusted under 35 U.S.C. 154(b) by 133 days.

(21) Appl. No.: 13/679,959

(22) Filed: Nov. 16, 2012

Related U.S. Application Data

(60) Provisional application No. 61/687,822, filed on May 3, 2012.

(51) Int. Cl.

| | |
|---|---|
| ***B65D 25/40*** | (2006.01) |
| ***B65D 25/42*** | (2006.01) |
| ***B65D 25/48*** | (2006.01) |
| ***B65D 47/06*** | (2006.01) |

(52) U.S. Cl.
CPC ..... *B65D 47/06* (2013.01)

(58) Field of Classification Search
CPC ..... B65D 25/42; B65D 25/48; B65D 47/06; B67D 3/0029
USPC ..... 222/181.1, 185.1, 1, 460, 408.5, 505, 222/243, 566–570; 141/311 R
See application file for complete search history.

(56) References Cited

U.S. PATENT DOCUMENTS

| | | | | |
|---|---|---|---|---|
| 3,481,513 | A | 12/1969 | Ram | |
| 4,023,602 | A * | 5/1977 | Sparr, Sr. | 141/311 R |
| 4,162,751 | A * | 7/1979 | Hetland et al. | 222/293 |
| 4,506,806 | A | 3/1985 | Lincoln et al. | |
| 4,569,463 | A | 2/1986 | Pellegrino | |
| 4,589,576 | A * | 5/1986 | Knight et al. | 222/357 |
| 4,673,111 | A | 6/1987 | Gold | |
| 4,900,160 | A * | 2/1990 | Brooks et al. | 366/347 |
| 5,217,108 | A * | 6/1993 | Newnan | 198/670 |
| 5,295,981 | A * | 3/1994 | Smith et al. | 604/301 |
| 5,437,400 | A * | 8/1995 | Loeffler | 222/570 |
| 6,283,334 | B1 | 9/2001 | Mahaffey et al. | |
| 7,175,069 | B1 | 2/2007 | Tsengas | |
| 2008/0083785 | A1 | 4/2008 | Nelson et al. | |

OTHER PUBLICATIONS

EZ Serve 05, http://www.rosseto.com/dry-food-dispensers/, accessed Nov. 14, 2012, 1 page.
EZ Serve Cereal & Snack Dispenser, http://www.containerstore.com/shop/kitchen/foodstorage/specialty?productId=10029939, accessed Nov. 14, 2012, 2 pages.
Candy & Nut Dispensers—Plow & Hearth, http://www.plowhearth.com/product.asp?pcode=6290, accessed Feb. 3, 2012, 2 pages.

* cited by examiner

*Primary Examiner* — Frederick C Nicolas
(74) *Attorney, Agent, or Firm* — Ryan Liebengood

(57) ABSTRACT

A dispenser including a chamber having a cavity, a spout in communication with the cavity and having an inner surface, a rotatable dial in communication with the spout and having an outer surface, and wherein the dial is positioned at least partially within the spout and rotates coaxially with the spout for dispensing a product within the cavity.

20 Claims, 21 Drawing Sheets

DISPENSING APPARATUS

CROSS-REFERENCE TO RELATED APPLICATIONS

This application claims the benefit of U.S. Provisional Application No. 61/687,822, filed on May 3, 2012, the disclosure of which is hereby incorporated herein by reference.

BACKGROUND

1. Technical Field

Aspects of this document relate generally to dispensing apparatus for consumer goods, snacks, nuts, and related items.

2. Background Art

Dispensing devices are known in the art to provide a number of consumer products by rotating a handle or knob. Some devices include gumball machines, bulk cereal dispensers, and similar dispensing apparatus. The dispensing devices may be refillable and provide a simple and sanitary way of providing small portions of bulk products. Traditional dispensing devices use a paddle wheel style agitator which rotates in the direction of the dispenser exit. While the paddle wheel style agitator does direct the product toward the dispenser exit, there is the potential for crushing or damaging the products between edges of the dispenser and the agitator.

SUMMARY

Aspects of this document relate to product dispensing devices. In one aspect, a dispenser includes a chamber having a cavity, a spout in communication with the cavity and having an inner surface, a rotatable dial in communication with the spout and having an outer surface, wherein the dial is positioned at least partially within the spout and rotates coaxially with the spout for dispensing a product within the cavity.

In one implementation, the dial may include an irregular portion on a first end and wherein the first end is positioned at least partially within the spout. The first end may include an agitator which selectively extends into the cavity when the dial is rotated. The agitator may agitate a product within the cavity when the dial is rotated to an open position. The chamber may be funnel shaped with a narrower portion adjacent the spout. The spout may further include an aperture and the dial further comprises an aperture. The dial aperture and spout aperture may be selectively aligned to dispense a product. The spout may be positioned at an angle with respect to the chamber. The dial may be positioned at least partially within the spout. The dial may further include at least one protrusion, wherein the protrusion limits axial movement in a direction into and out of the spout.

In another implementation, the dispenser may further include a container positioned on the chamber to provide the product. The chamber may further include a sealing lip engaging with the container. The container may further include two removable lids, wherein one of the lids is small enough to prevent removal of the chamber and the dial. The support may further include a spout having a threaded mounting surface having two or more mounting threads with different thread angles. The container may engage only one of the two or more mounting thread angles. The dispenser may further include an adapter positioned between the chamber and a container, wherein the adapter reduces a size of a threaded mounting surface.

In another aspect, a method of dispensing a product includes the steps of providing a chamber having a cavity in communication with a spout having an aperture, a dial having an aperture and a protrusion, rotating the dial to move the protrusion along an edge of the cavity, and agitating a product within the cavity during the rotation step without compacting the product with the protrusion.

In another aspect, a dispenser includes a chamber having a cavity and a container mounting surface for removably securing a container, the container mounting surface further including two or more mounting threads having different lengths or angles.

In an implementation, the two or more mounting threads may be four mounting threads, wherein two of the mounting threads having a first length and the remaining two of the mounting threads having a second length different than the first length. The two or more mounting threads may be four mounting threads, wherein two of the mounting threads are positioned at a first angle and the remaining two of the mounting threads are positioned at a second angle different than the first angle.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Embodiments of the present invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended operation and assembly procedures for a product dispenser will become apparent for use with implementations of a product dispenser from this disclosure. Accordingly, for example, although particular components are disclosed, such components and other implementing components may comprise any shape, size, style, type, model, version, measurement, concentration, material, quantity, and/or the like as is known in the art for such implementing components, consistent with the intended operation of a product dispenser.

Product dispensers have formerly incorporated a rotatable knob to facilitate removal of a product within the dispenser cavity. These approaches, however, have damaged the product therein, particularly when easily crushable, since the removal device could compress the product therein. The product dispenser of the present disclosure provides a cavity with a rotatable dial which operates in a direction co-axial with a spout. The spout may extend downward from the chamber at an angle to assist with dispensing the product from the cavity.

The dial may be positioned inside the spout and include a removable cap to prevent inadvertent loss of the product. Both the spout and dial may include apertures which can be aligned with one another by rotating the dial to dispense the product in the cavity. When the desired amount of product has been dispensed, the dial is rotated so that the apertures are not aligned with one another. The removable cap may also be used to catch the product being dispensed from the apertures to reduce contact with the apertures and maintain a clean, sanitary dispenser.

The dial may include a first end having an agitator and a second end, opposite the first end, with a knob for rotating the dial. The agitator may extend from the first end at only a portion of the first end and be positioned such that when the dial is in the closed position the agitator is adjacent a cavity wall and does not interact with the product in the cavity. However, during rotation of the dial, the agitator may also rotate and contact a portion of the product within the cavity along a sidewall of the cavity. However, the agitator does not compress the product since the agitator moves in a direction along the cavity sidewalls. The dial rotates in a direction co-axial with the spout as the dial may be positioned within and extend out of the spout. Advantageously, the co-axial relative rotational movement of the dial and spout permits the agitator to selectively extend into the cavity to agitate the product therein without crushing or compacting the product.

Figure 1:
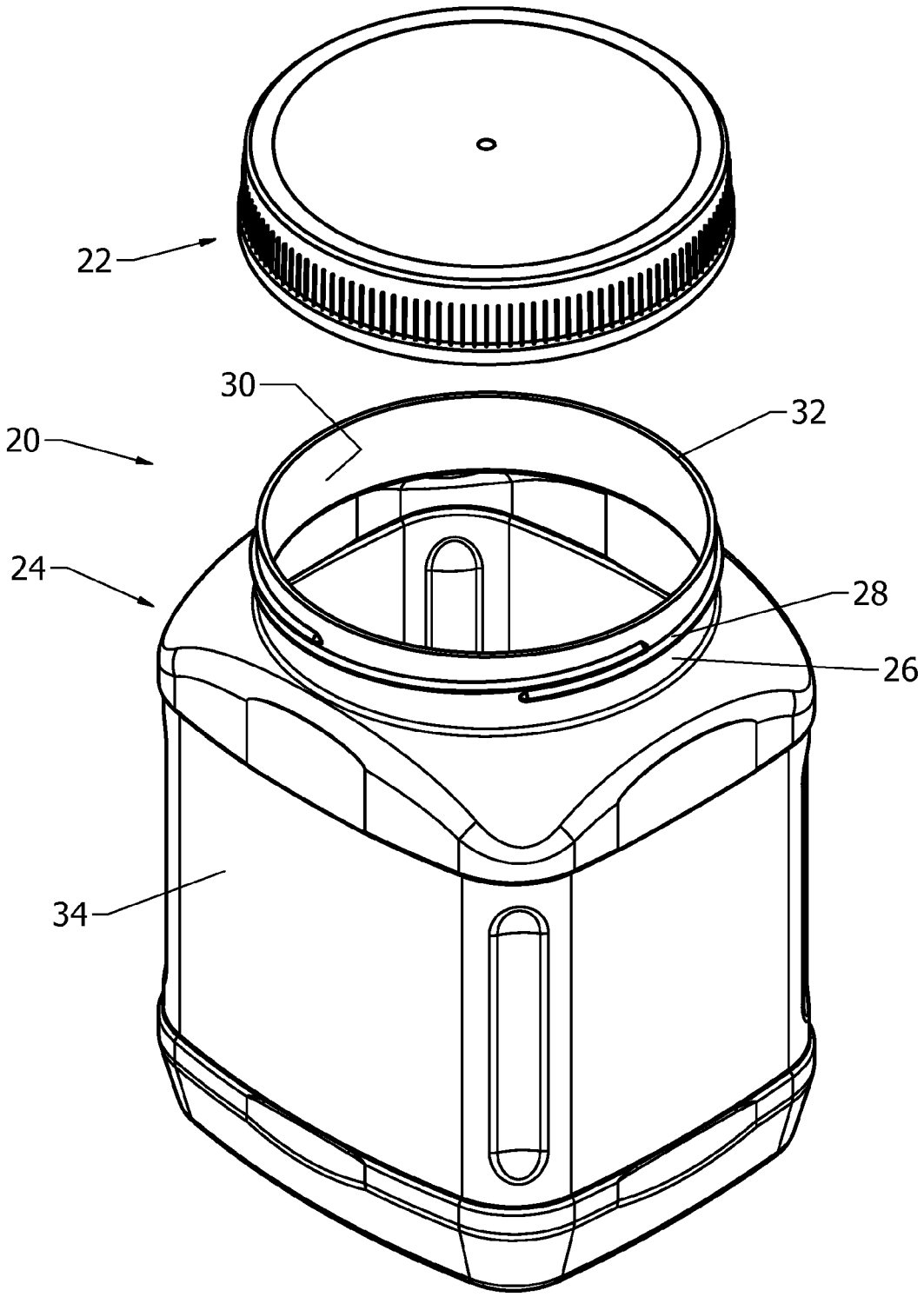
FIG. 1 is a perspective exploded view of a product container.

Referring now to FIG. 1, a product container 20 is shown with a lid 22 and a container 24 separated from one another. Container 24 includes a neck 26 extending upwards and having a threaded portion 28 thereon. The neck 26 also includes an inner surface 30 with a top surface 32. Container 24 also includes a body 34 for holding a dispensable product. Thus it is seen that product container 20 may be any number of suitable product containers and may be a commonly known size, shape, and threaded portion. The threaded portion 28 may be any suitable thread pitch and any suitable length around the neck 26. The container 24 may be useful to house nuts, candy, or any other desired product.

Figure 2:
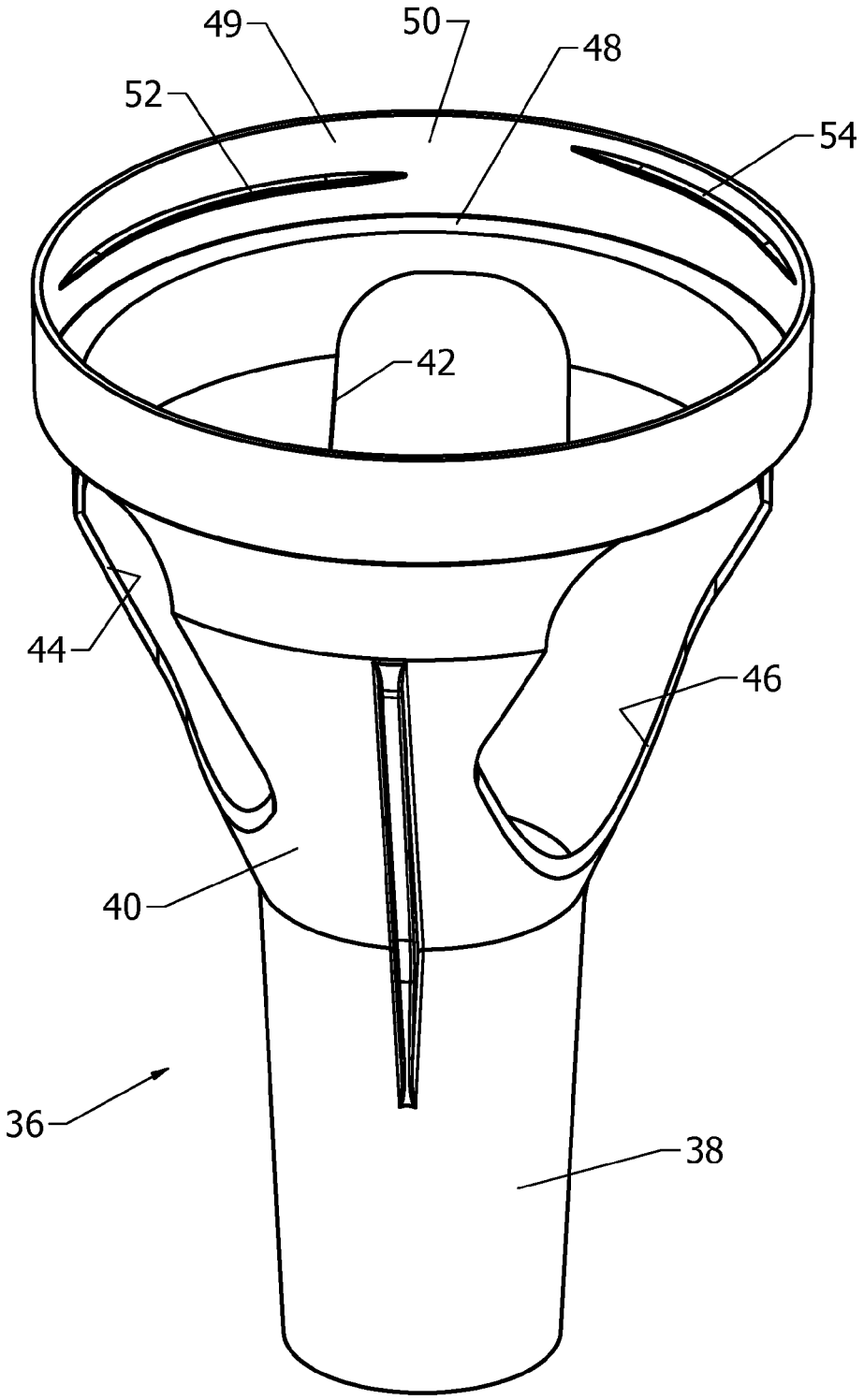
FIG. 2 is a perspective view of a support.
Figure 3:
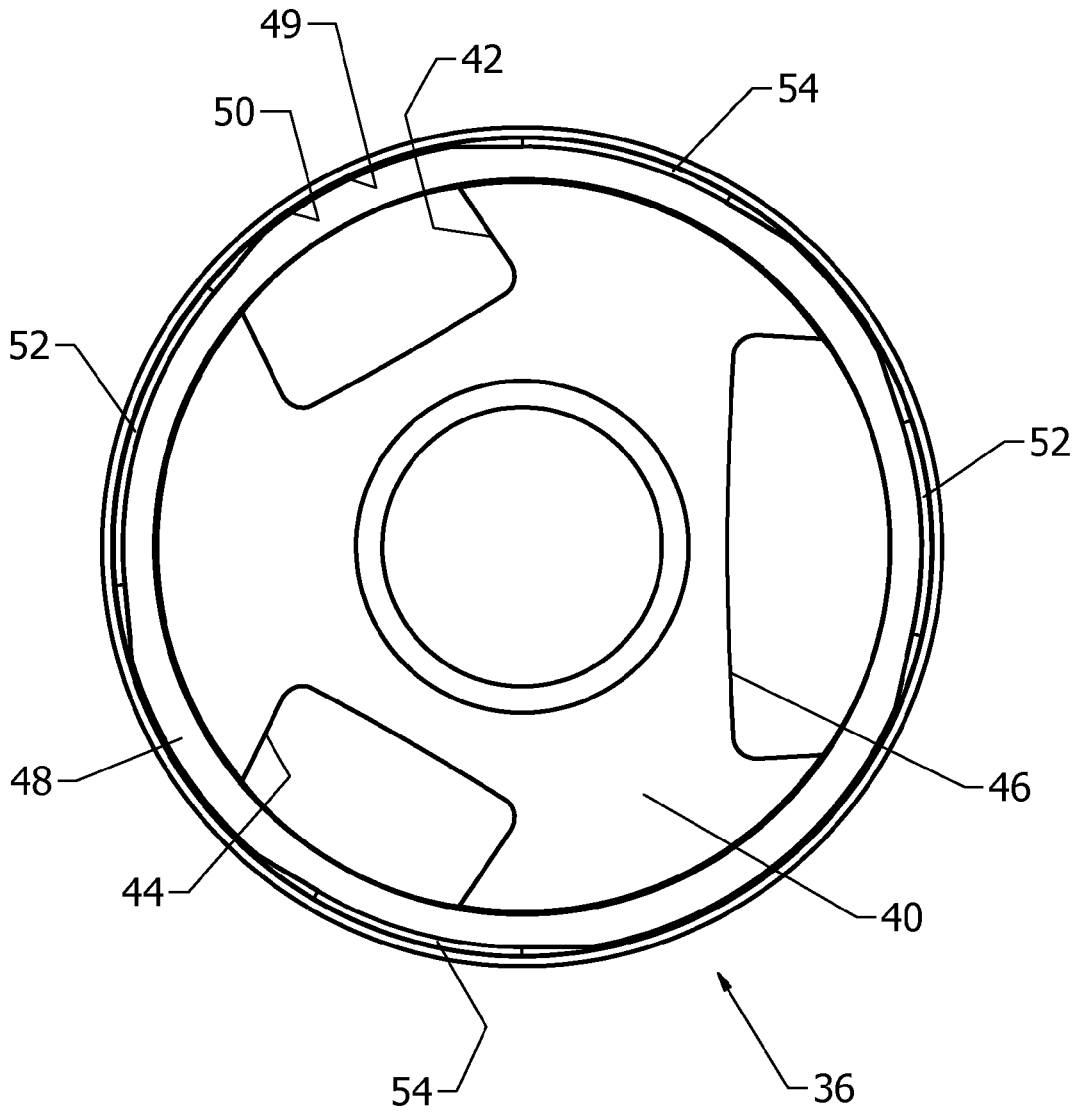
FIG. 3 is a top view of the support.

FIGS. 2 and 3 illustrate a perspective view and top view of a support 36 having a mounting section 38 and an expanding section 40 with three apertures 42, 44, and 46 therein. Expanding section 40 also includes a ridge 48 and a neck 49 having an inner surface 50 with a first mounting thread 52 and a second mounting thread 54. Apertures 42, 44, and 46 may be positioned approximately 120 degrees apart, with apertures 42 and 44 being of similar size and both being smaller than aperture 46. Apertures 42 and 44 may together function as a handle, while aperture 46 is arranged to receive the spout as will be discussed in greater detail below. A person of ordinary skill in the art will immediately appreciate that apertures 42, 44, and 46 may be any suitable size and apertures 42 and 44 may be omitted without departing from the spirit and scope of the present disclosure.

Ridge 48 assists with positioning container 24 and particularly receiving top surface 32, while inner surface 50 is arranged to surround neck 26 as will be discussed in greater detail below. First mounting thread 52 may have a length between 15 degrees and 45 degrees, with a pitch between approximately 0.050" and 0.400". In one preferred implementation, each of the first mounting thread 52 has a length of approximately 30.6 degrees along the circumference of inner surface 50 at a pitch of approximately 0.200" with the first mounting threads 52 being positioned approximately 165 degrees apart. Second mounting thread 54 may have a length between 30 degrees and 60 degrees, with a pitch between approximately 0.200" and 0.800". In one preferred implementation, each of the second mounting threads 54 has a length of approximately 45 degrees along the circumference of inner surface 50 at a pitch of approximately 0.500" with the second mounting threads 54 being positioned approximately 180 degrees apart. It can also be seen that the first mounting threads 52 are positioned between the second mounting threads 54, while the second mounting threads 54 are positioned between the first mounting threads 52 in one implementation. In other implementations, there may be two first mounting threads 52 and two second mounting threads 54 on the neck 49 inner surface 50. Although only two mounting thread pitches and lengths are described on inner surface 50, any suitable number and length of mounting threads may be incorporated to fit any number of various product container 24 thread lengths and pitches, so long as the unused mounting threads on inner surface 50 do not interfere with the threads on the product container. For example, one continuous mounting thread may be utilized instead of the multiple threads disclosed above. In the single continuous mounting thread implementation, the thread pitch may be any of those discussed herein, or any other suitable thread pitch. Accordingly, the arrangement of mounting thread pitches, orientation, and length has been shown to advantageously fit the known various product container neck threads without additional modification to inner surface 50.

Figure 4:
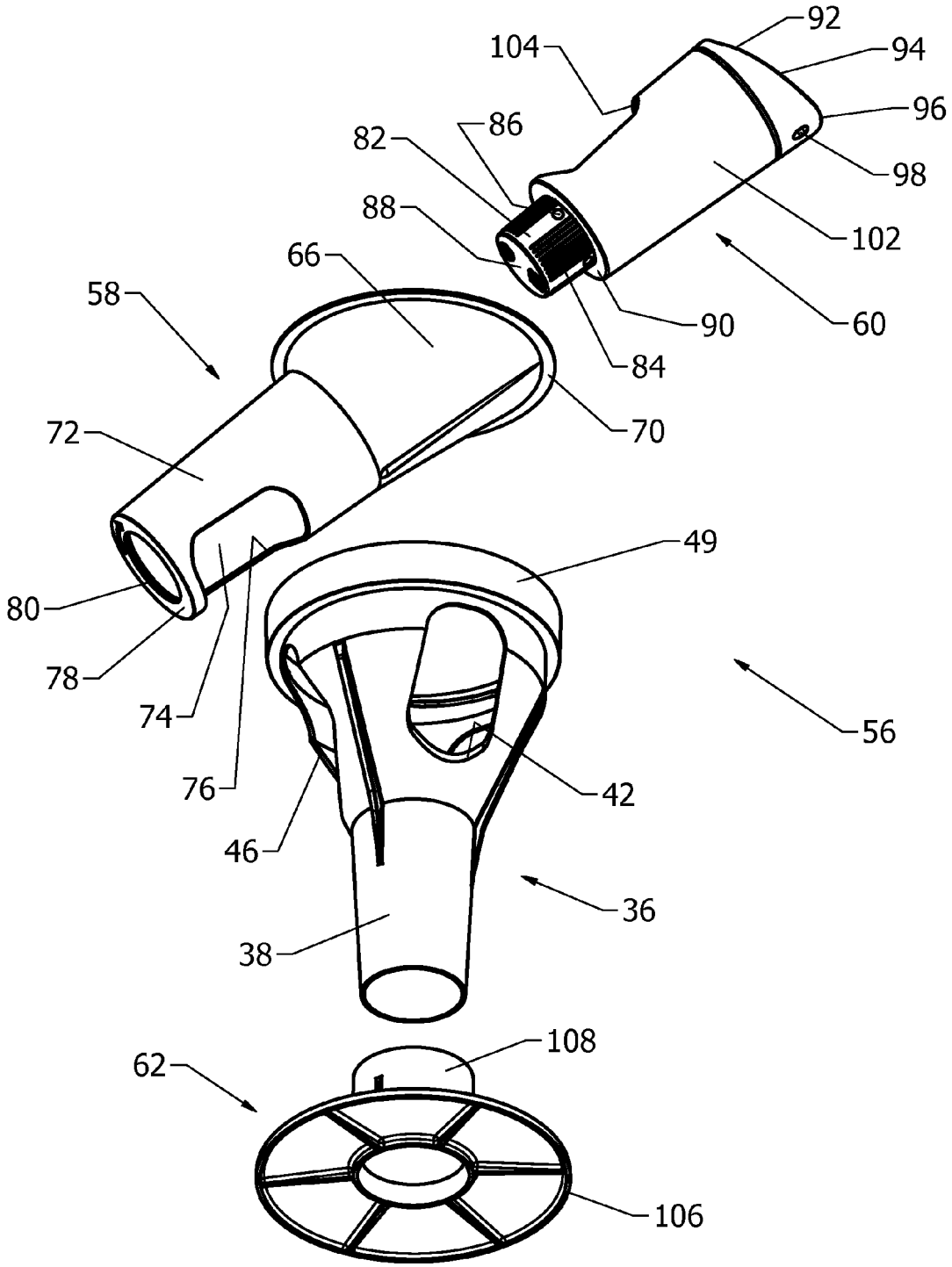
FIG. 4 is a perspective exploded view of the support, a base, a chamber, and a dial.
Figure 5:
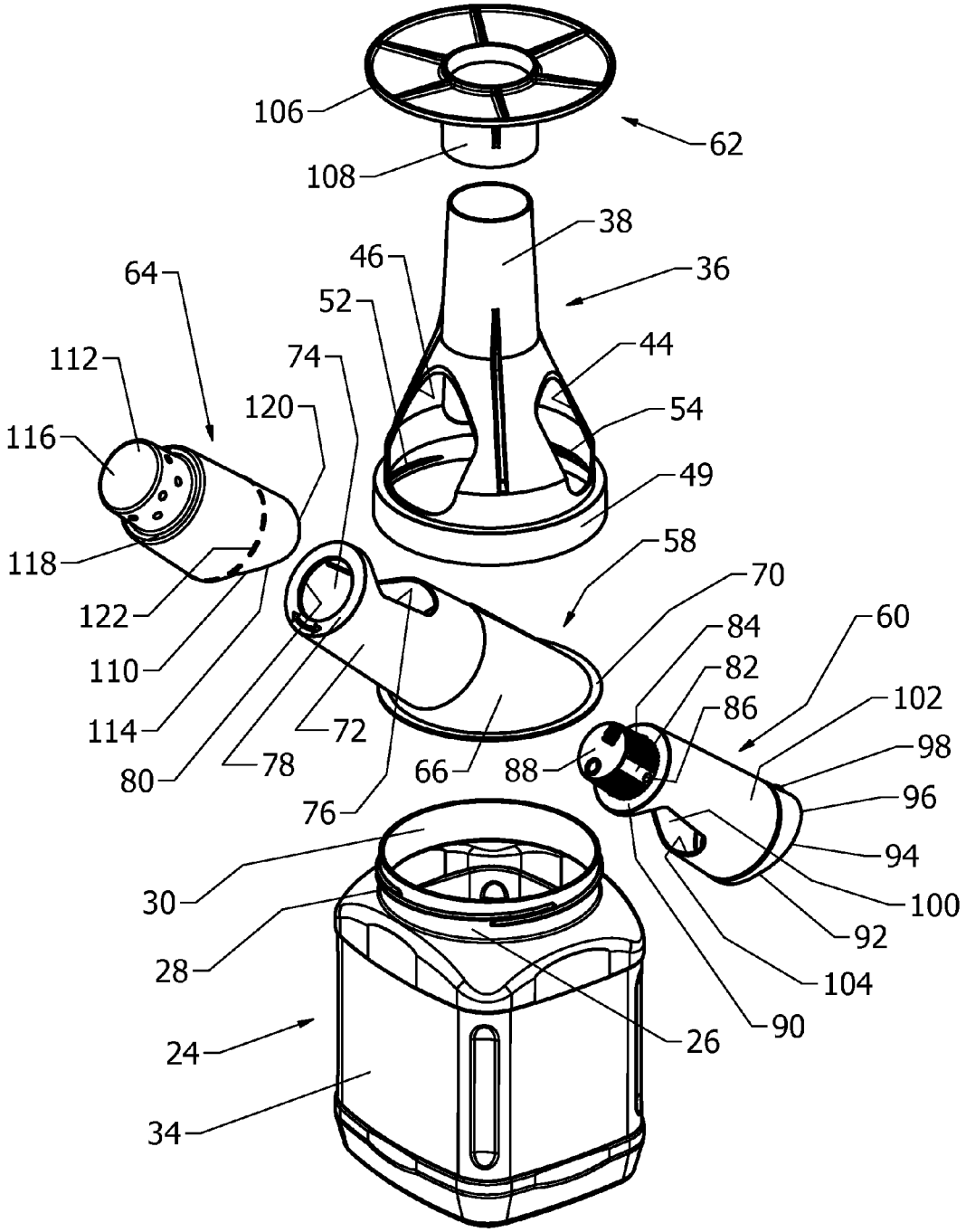
FIG. 5 is a perspective exploded view of the support, the base, the chamber, the dial, and a cap above the product container.
Figure 6:
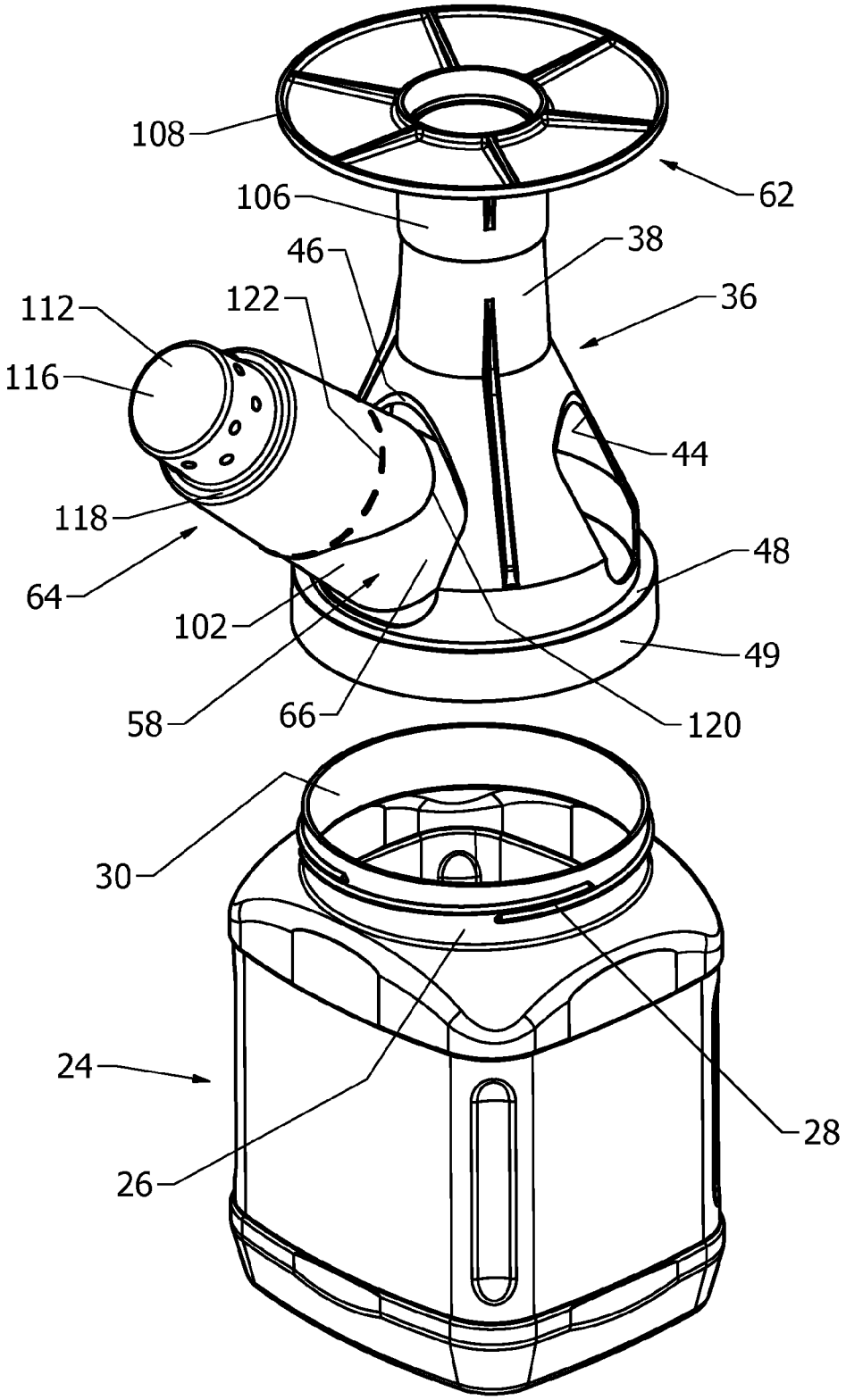
FIG. 6 is a perspective view of an assembled product dispenser separated from the product container.
Figure 7:
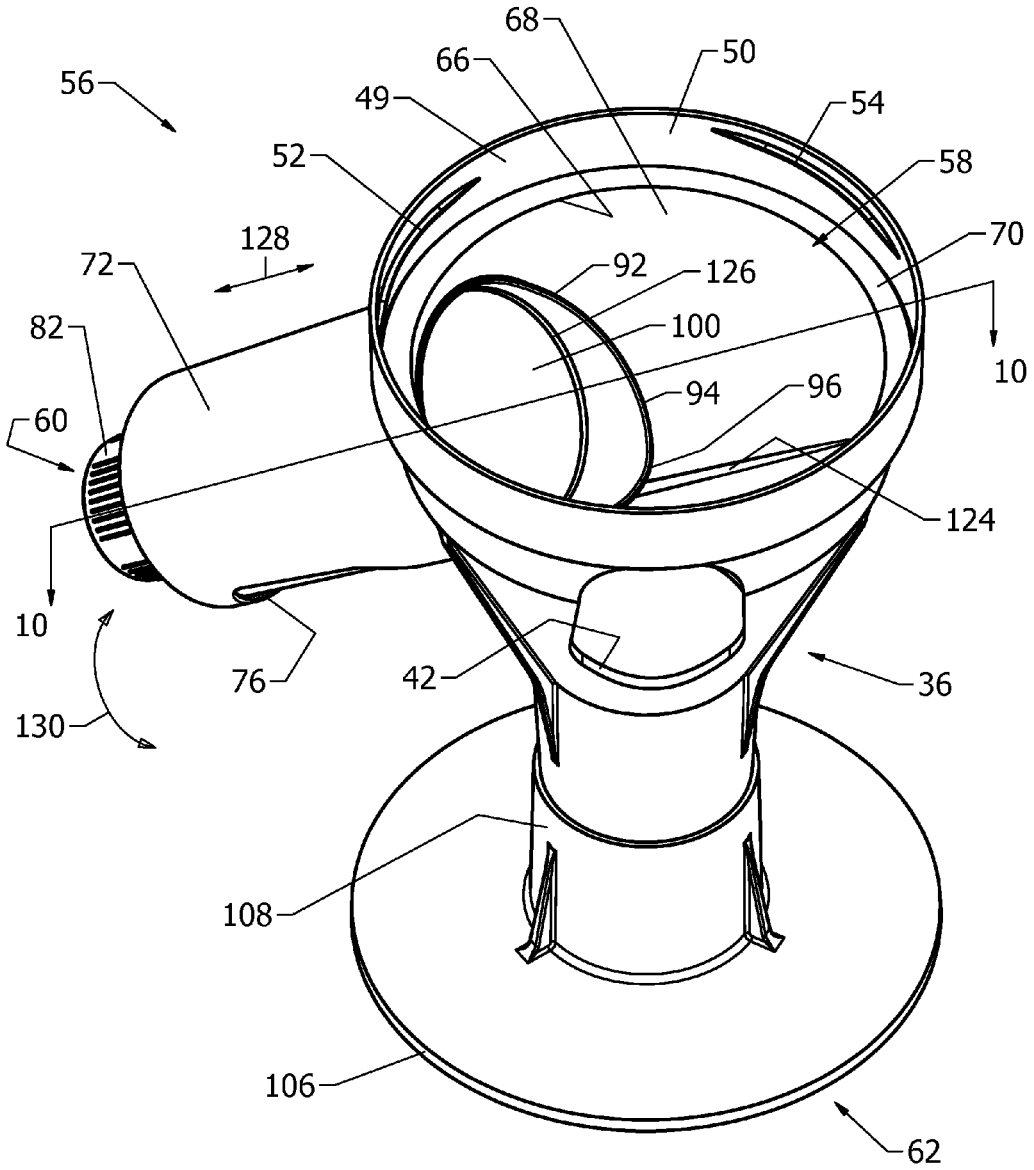
FIG. 7 is a perspective view of the chamber on the support and the dial in a closed position.

FIGS. 4 through 6 illustrate various additional components of a dispenser 56. Dispenser 56 includes the support 36, a chamber 58, a dial 60, a base 62, and a cap 64. Chamber 58 includes a funnel shaped cavity 66 on an inner surface 68 as shown in FIG. 7 for example. Cavity 66 extends from a sealing surface or lip 70 to a spout 72 and narrows from the sealing lip 70 to spout 72. Cavity 66 is arranged to receive a product therein and direct the product to the spout 72 as will be discussed below. To assist with offsetting spout 72, spout 72 may be positioned at an angle with respect to cavity 66. Spout 72 includes an inner surface 74 in communication with inner surface 68 of cavity 66 and includes an aperture 76 for dispensing the product and a mounting end 78 having a mounting hole 80 opposite cavity 66. Similar to cavity 66, spout 72 may also have a generally funnel shape whereby mounting end 78 is smaller in diameter than the opposite end adjacent cavity 66.

Dial 60 includes a knob 82 having frictional features 84 such as ridges and protrusions 86 on a second end 88 adjacent a shoulder 90. A first end 92, opposite second end 88, includes an irregular portion 94 having an agitator 96 on one portion of the first end. Further, a protrusion 98 adjacent first end 92 allows protrusions 86 and 98 together retain dial 60 rotatably captive within spout 72 as will be discussed in greater detail below. The dial 60 also includes an inner surface 100 and an outer surface 102 with an aperture 104 extending through both surfaces and between the first end 92 and the second end 88.

Base 62 includes a stand 106 with a stand mount 108 extending upwards from the stand. Stand mount 108 is arranged to receive support 36 thereon once the dispenser 56 is fully assembled. Finally, stand 106 is of sufficient stature and width to maintain support 38, chamber 58, dial 60, cap 62, and product container 20 when fully assembled.

Cap 64 may include a first end 110 opposite a second end 112, with the first end 110 having an opening 114 and second end 112 having a sealed portion 116 with a shoulder 118. Sealed portion 116 is arranged to fit over knob 82, while shoulder 118 is arranged to fit over shoulder 90 of the dial 60. Cap 64 may also include a scoop portion 120 extending beyond first end 110 and indicators 122 providing approximately one-half of a cup of the product. Specifically, scoop portion 120 is used to collect the product as the product exits aperture 76 in spout 72. Scoop portion 120 is helpful to extend further under spout 72 to collect the dispensed product without having to touch the aperture 76 with the user's hand. Further, indicators 122 can be used to determine a specific serving size without requiring an additional and separate measuring device.

Figure 8:
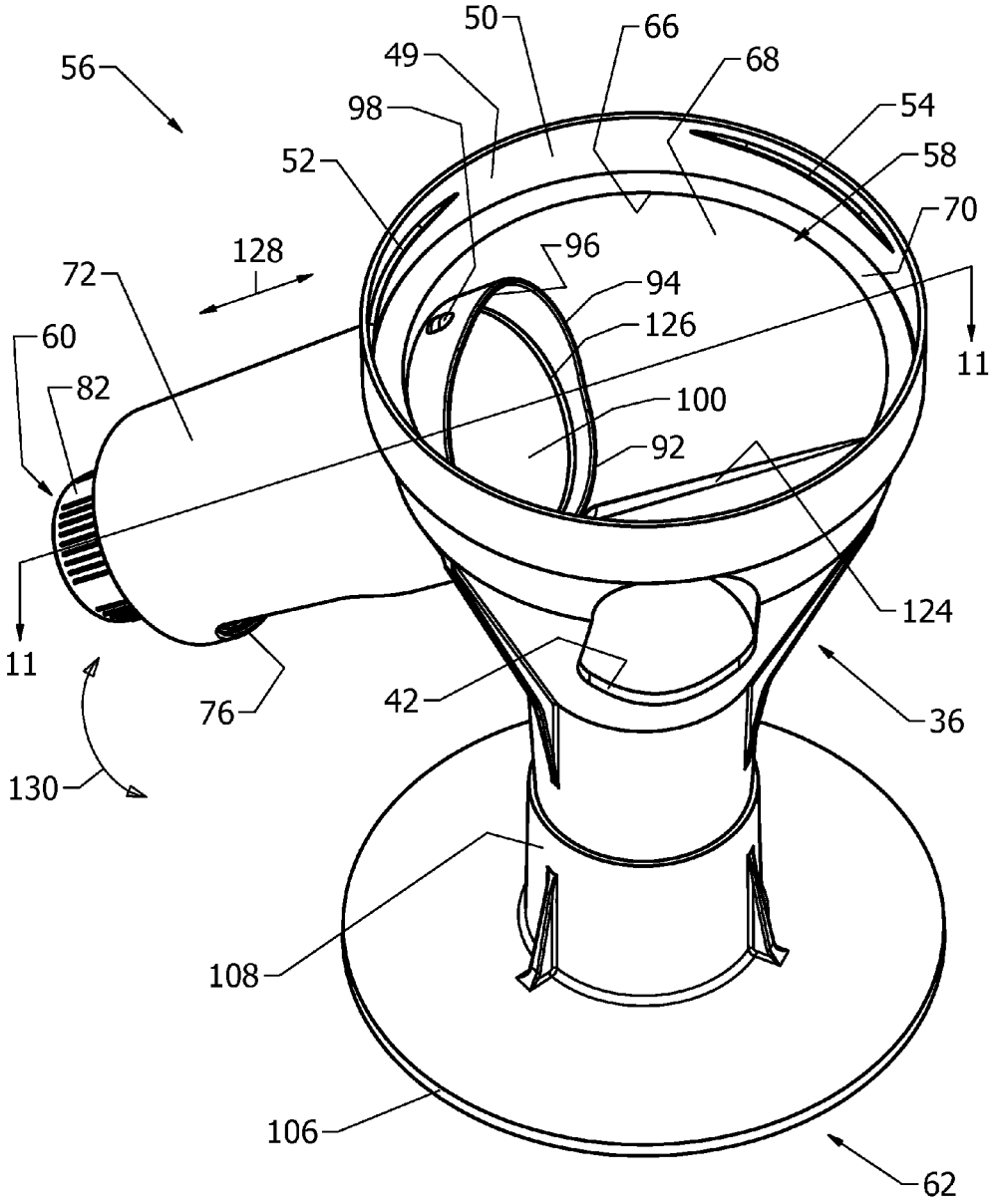
FIG. 8 is a perspective view of the chamber on the support and the dial in an open position.
Figure 9:
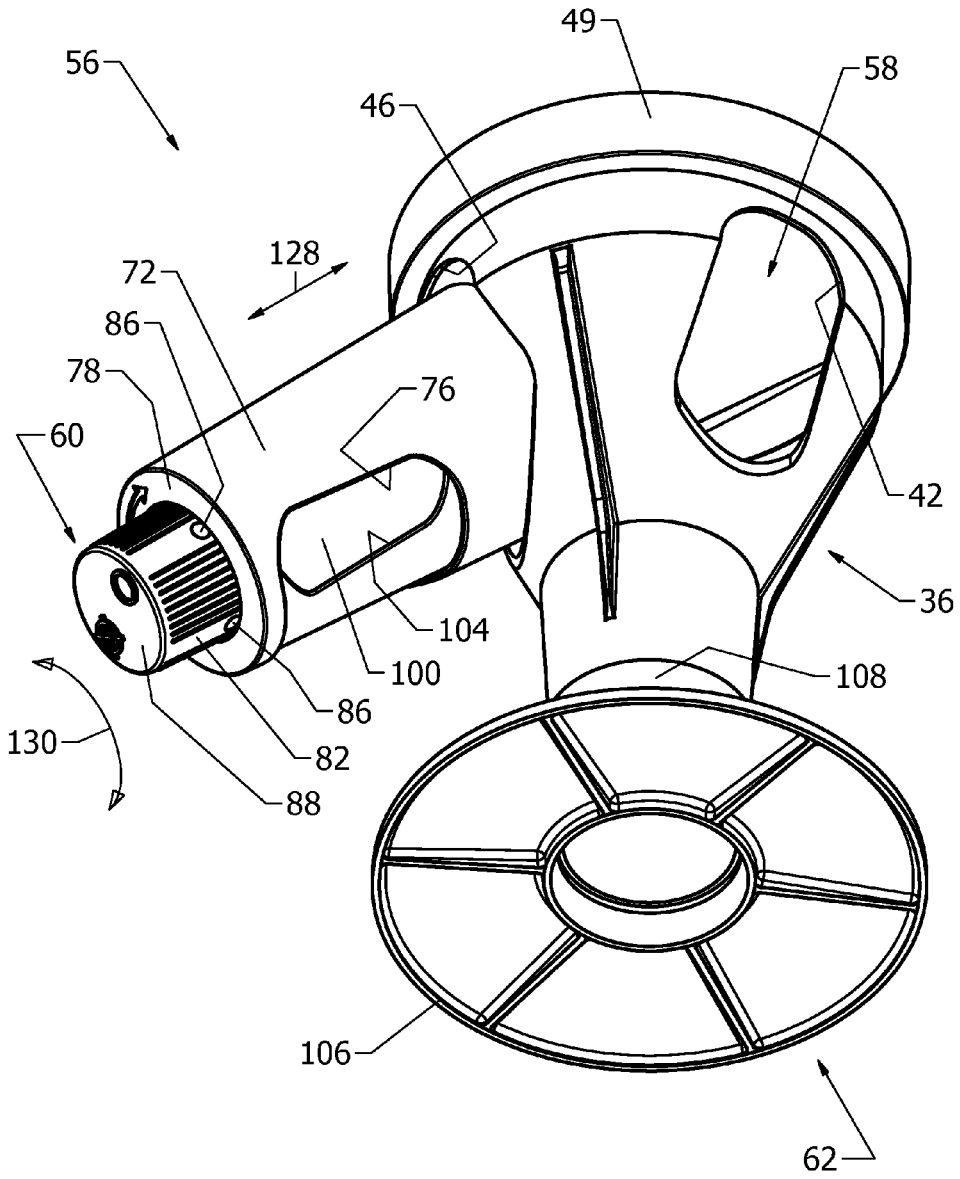
FIG. 9 is a perspective view of the support and chamber with the dial in a partially open position.
Figure 10:
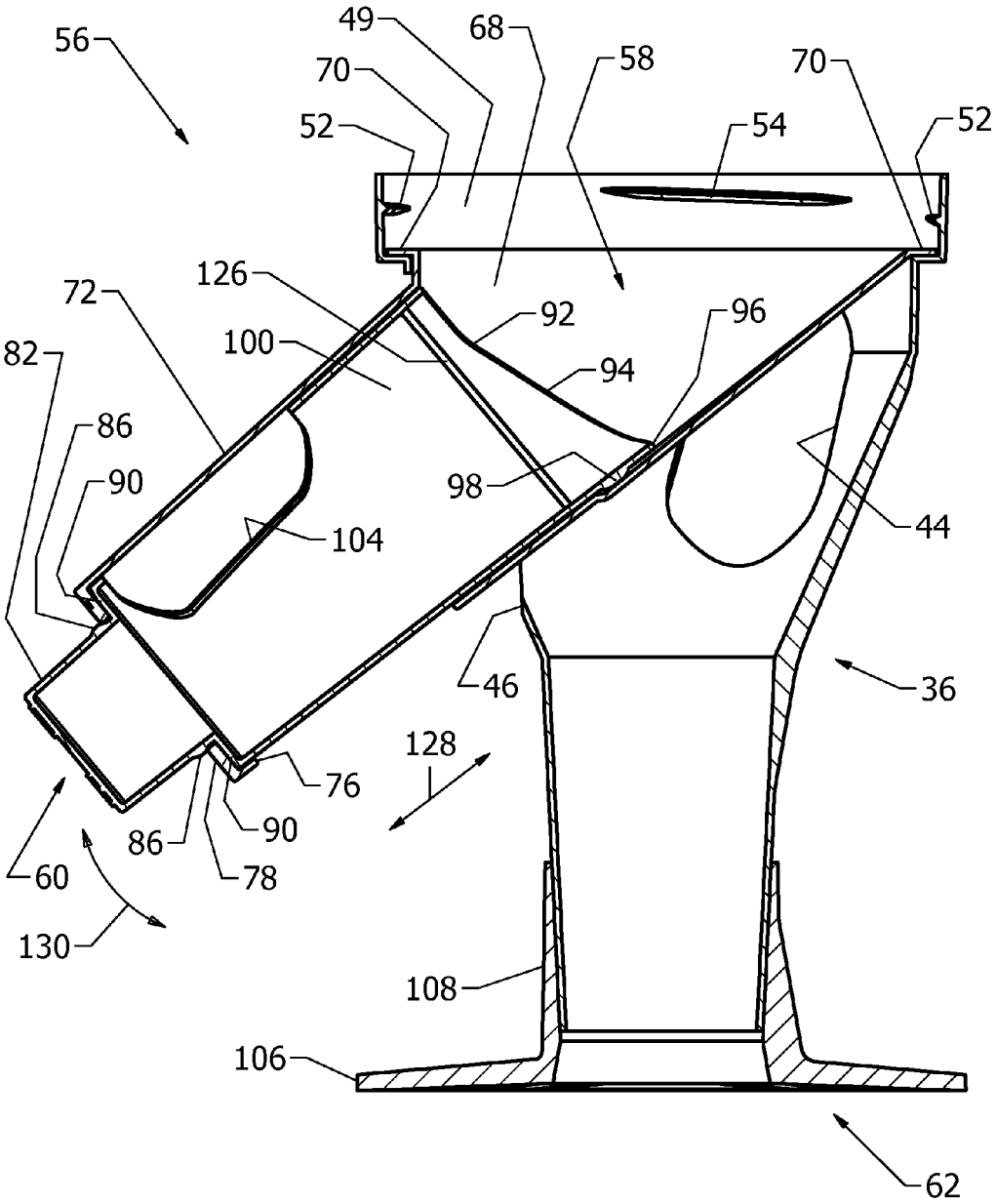
FIG. 10 is a sectional view of the support and chamber taken generally about line 10-10 in FIG. 7.
Figure 11:
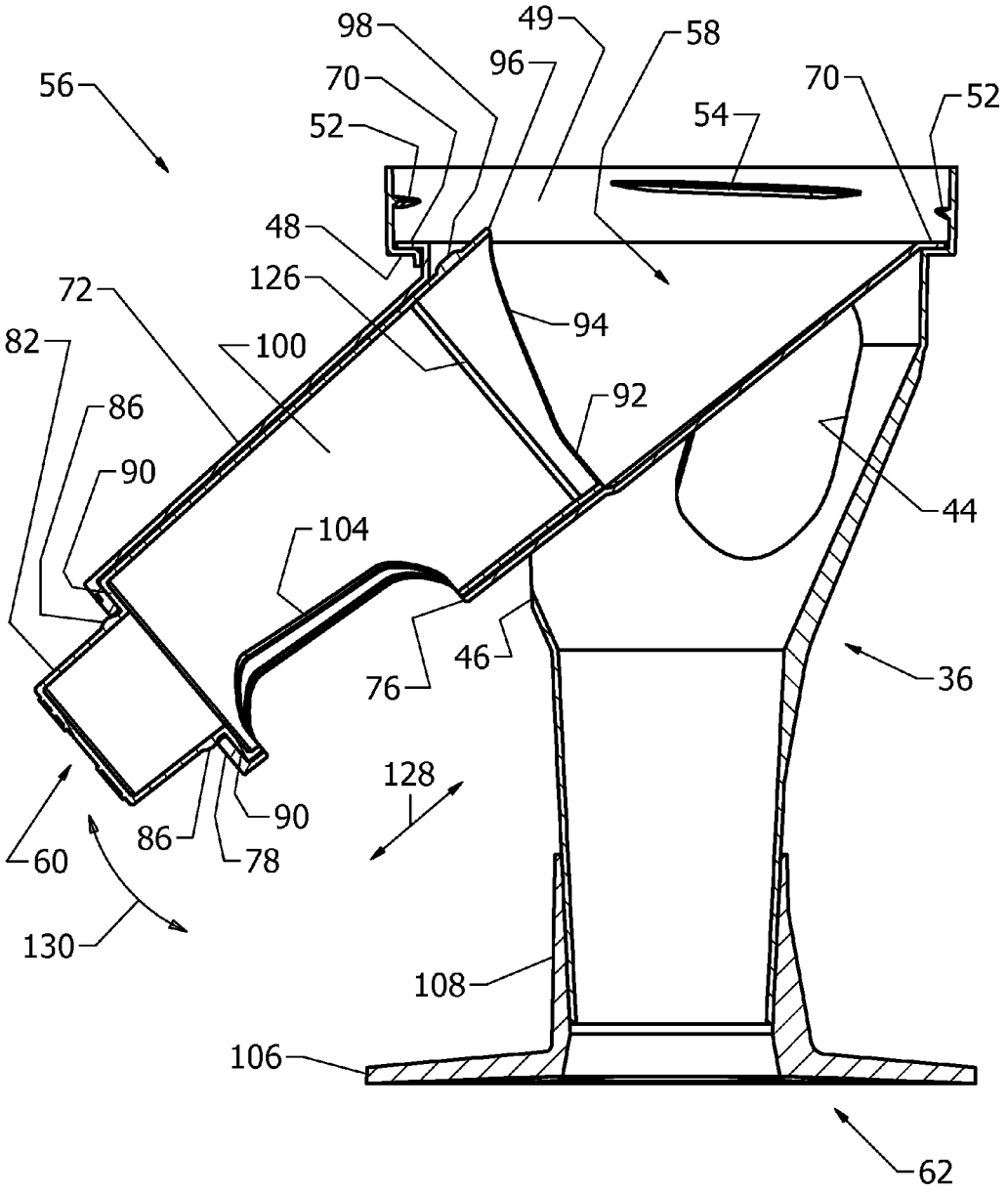
FIG. 11 is a sectional view of the support and chamber taken generally about line 11-11 in FIG. 8.
Figure 12:
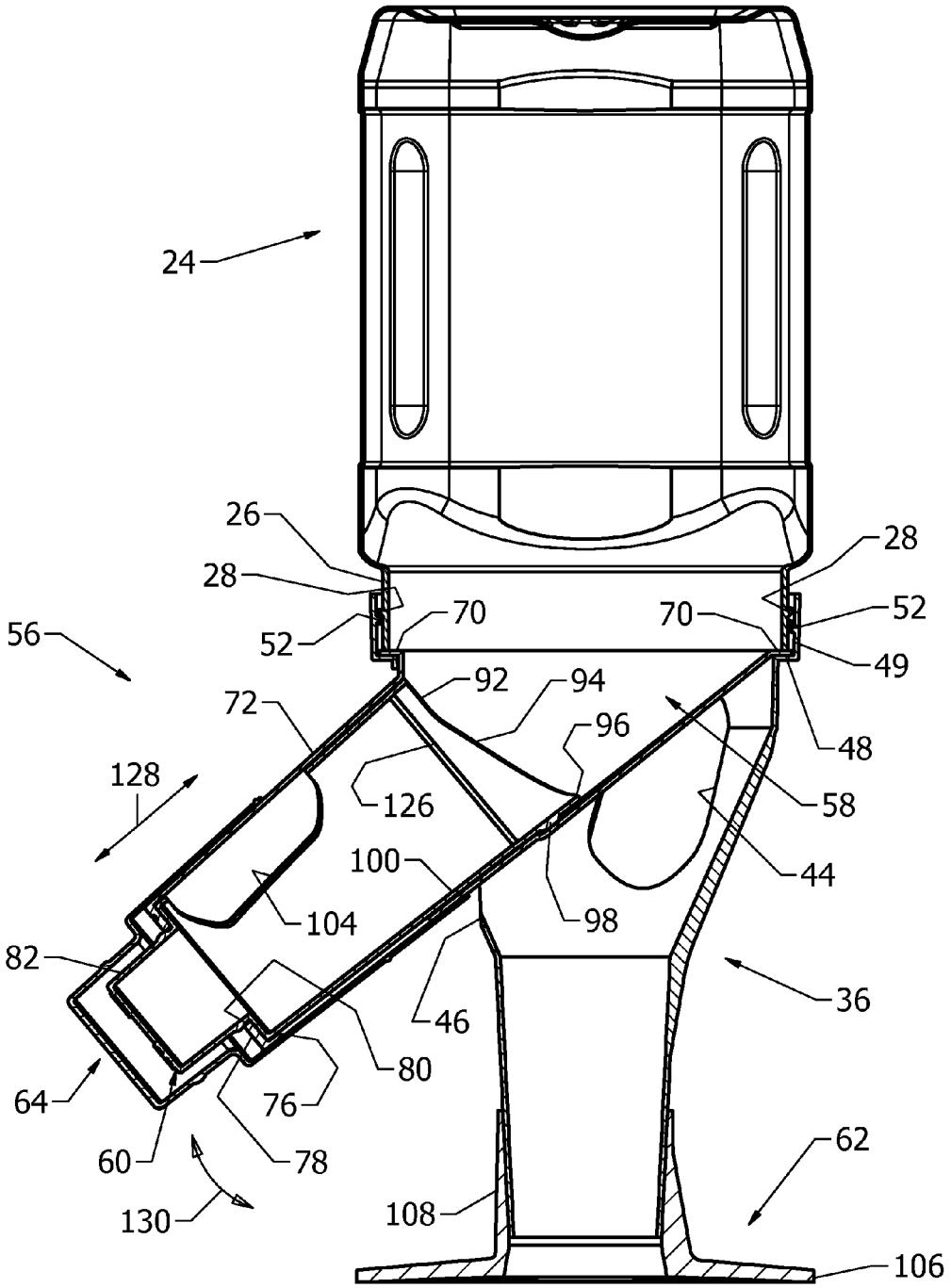
FIG. 12 is a sectional view of the base and chamber with a product container mounted on the support.

FIGS. 7 through 12 illustrate various operational views of dispenser 56 from fully closed to fully open. Specifically, FIGS. 7, 10, and 12 are views with the dial 60 in a fully closed position, while FIG. 9 is a view with the dial 60 in a partially open position, and FIGS. 8 and 11 are views with the dial in the fully open position. FIGS. 7-8 and 10-12 also illustrate an alignment ridge 124 which is arranged to receive protrusion 98 of dial 60 when the dial is in the fully closed position. Further, a raised annular ridge 126 may extend around and from dial 60 near first end 92. Raised annular ridge 126 is used to assist with positioning dial 60 within spout 72 and works with shoulder 90. Shoulder 90 and protrusions 86 limit axial movement in the direction associated with arrows 128, while still permitting rotational movement of dial 60 in the directions associated with arrows 130. Raised annular ridge 126 assists with rotational movement in the direction associated with arrows 130 by reducing the frictional engagement between dial 60 and spout 72 inner surface 74. In the same manner, protrusions 98 assist with the same rotational movement by also reducing friction between mounting hole 80 in mounting end 78. Protrusions 98 and raised annular ridge 126 reduce the friction between the dial 60 and the spout 72 by decreasing the surface area in contact between the dial and the spout.

Dial 60 is inserted through chamber 58 and into spout 72 until knob 82 extends through mounting hole 80 until a snap or click is felt when protrusions 86 and raised annular ridge 126 are engaged with spout 72. Specifically, protrusions 86 are positioned outside of spout 72 and together with mounting end 78 are used to limit axial movement in the direction associated with arrows 128. Chamber 58, with dial 60 therein, may then be inserted from inside support 36 and through aperture 46 until lip 70 rests on ledge 48. The base 62 may be secured to the bottom of support 36 and a container 24 may be secured to neck 49 at first mounting threads 52 or second mounting threads 54 depending on the container threaded portion 28. Specifically, container 24 may include a variety of different possible threaded portion angles or lengths as there is no one standard in the industry. The inventors of the present disclosure have determined that the particular orientation, angles, and circumferential distances of first mounting threads 52 and second mounting threads 54 provide the optimal ability to secure any of the various presently known container threading portions 28 without interference. Accordingly, a variety of different threaded portions 28 may be secured to dispenser 56 without replacing chamber 58 with a specific thread pattern.

Once the container 24 is positioned on dispenser 56, a product (not shown) within the dispenser will be fed by gravity into chamber 58 and dial 60 through spout 72. When dial 60 and knob 82 are in the fully closed position, protrusion 98 is generally positioned within alignment ridge 124 and provides a resistive feedback when dial 60 is rotated in the direction associated with arrows 130. As discussed above, protrusions 86 in combination with mounting end 78 limit axial movement of dial 60 within spout 72 in the direction associated with arrows 128.

Dial 60 may be rotated in either direction associated with arrows 130. When dial 60 is in the closed position, aperture 104 of the dial is positioned facing upwards within spout 72, while aperture 76 of spout 72 is always positioned downward to dispense a product from the spout when aperture 104 of dial 60 is at least partially aligned with aperture 76. Thus, it is seen that dial 60 must be rotated sufficiently to at least partially align apertures 76 and 104 to an extent that the product can pass through both apertures. Further, the tight tolerance and close proximity between dial 60 outer surface 102 and spout 72 inner surface 74 prevents the product from disrupting the relative rotational movement between dial 60 and spout 72. Still further, since the product can only be dispensed when the apertures are aligned, the user can easily limit flow of the product therein once the cap 64 is removed.

Another aspect of dispenser 56 is agitator 96 of irregular portion 94 on first end 92 of dial 60. Irregular portion 94 may extend further beyond other portions of first end 92 and thereby extend partially into chamber 58, or at least beyond spout 72 and the remaining portions of first end 92. More importantly, first end 92 irregular portion 94 and specifically agitator 96 disrupt or agitate a product within chamber 58 when dial 60 is rotated in the directions associated with arrows 130. For example, when dial 60 is in the closed position, agitator 96 and irregular portion 94 do not contact the product since the agitator 96 and irregular portion are in contact with inner surface 68 of cavity 66. However, as the dial 60 is rotated, the agitator extends away from inner surface 68 of cavity 66 and may come into contact with the product in chamber 58 to agitate or disrupt the product near the agitator or irregular portion. This relatively simple movement has been shown to be sufficient to dislodge any clumps of the product without damaging or crushing the product since the agitator does not compress the product between the agitator and the cavity inner surface 68 during operation. Another advantageous aspect of irregular portion 94 and agitator 96 on first end 92, besides both portions extending selectively into cavity 66, is that the irregular portion 94 and agitator 96 operate with and during rotation of dial 60 to simplify operation. For example, the agitator 96 operates to move or agitate the product, regardless if product dislodging is needed once the dial 60 is rotated beyond a position where the agitator is no longer in contact with inner surface 68 of cavity 66.

Thus it is seen that once the dispenser 56 is assembled, the dispenser may be transferred to and connected to any number of containers 24. The cap 64 may be removed and used to collect a specified amount of the product from the dispenser and further limits the transfer of germs and disease since the user's hands do not touch portions of the dispenser which actually provide the product. After removing cap 64, the user rotates the dial 60 in either direction associated with arrows 130 until the apertures 76 and 104 are at least partially aligned enough to produce an opening sufficient to permit the product within chamber 58 and spout 72 to pass through. During this rotation of dial 60, agitator 96 and irregular portion 94 provide dislodging assistance for the product and ensure that there is a continuous and steady flow of the product. Should the user leave the dial in an open or partially open position and the product cease to dispense through the apertures, the user need simply rotate dial 60 in either direction to once again utilize agitator 96 and irregular portion 94 to assist with moving the product within cavity 66. Once the user has dispensed the desired amount of product, the user simply rotates dial 60 until feeling that protrusion 98 is within alignment ridge 124 or another suitable indicator that the apertures 76 and 104 are no longer aligned with one another.

A number of steps and operations have been discussed above. A person of ordinary skill in the art will immediately appreciate that certain steps may be omitted or reorganized to produce the same result of dispensing a product. Further, the agitator 96 and irregular portion 94 shown are merely exemplary and any suitable displacing device, component, or addition may be utilized to produce the same or a similar result of dispensing a product. Accordingly, the present disclosure is merely exemplary of a method and apparatus for dispensing a product and any suitable devices and orientations may be utilized without departing from the spirit and scope of the present disclosure.

Figure 13:
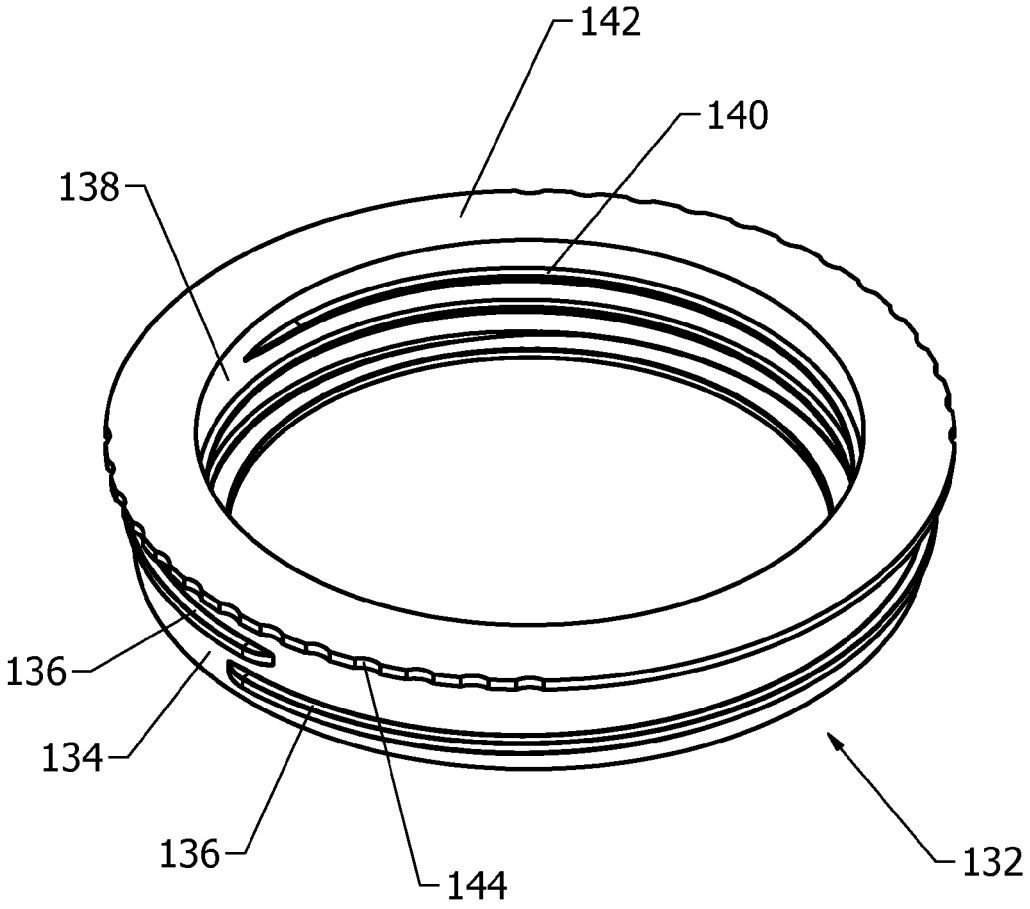
FIG. 13 is a perspective view of an adapter to secure product containers of various sizes to the product dispenser.
Figure 14:
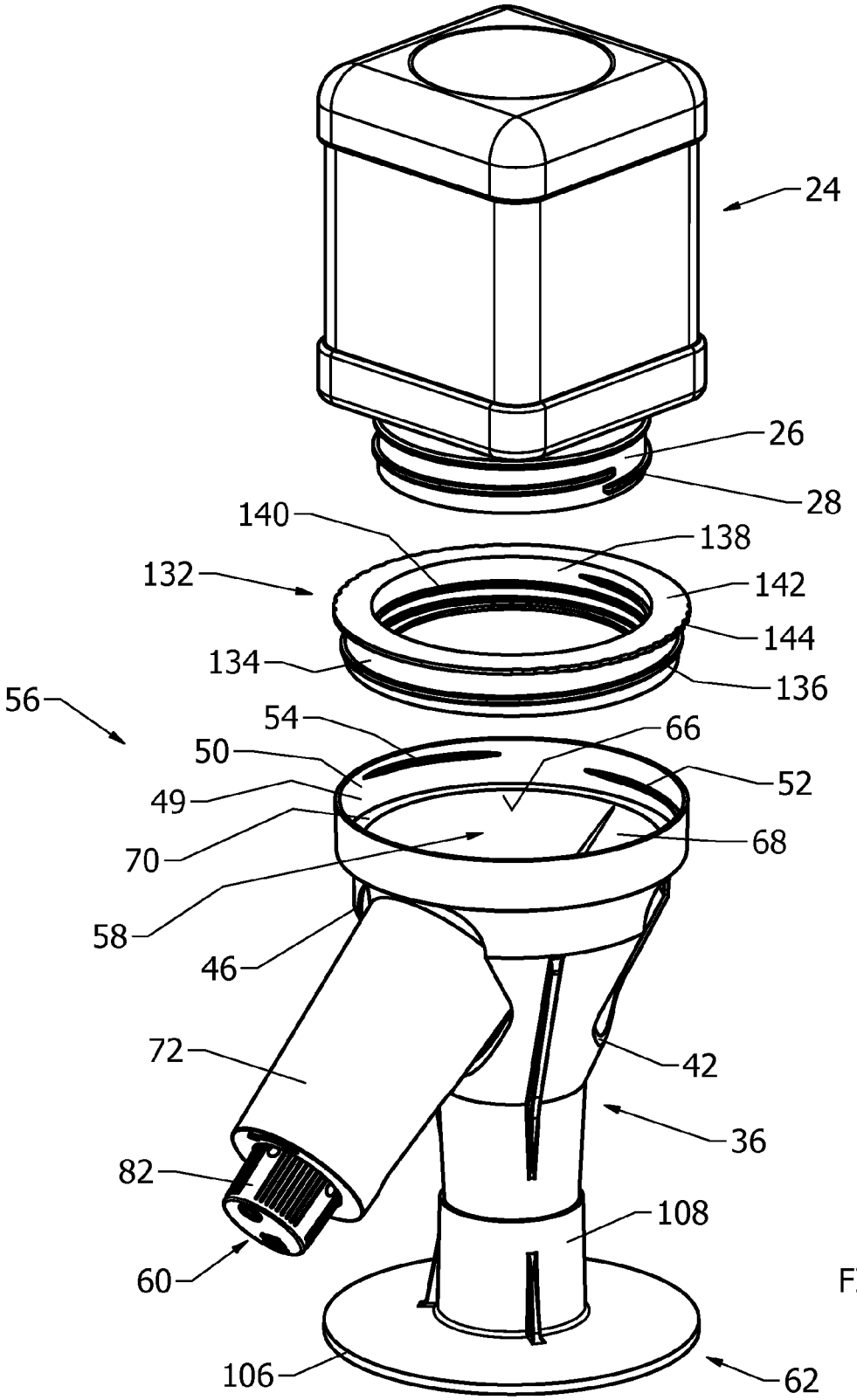
FIG. 14 is a perspective exploded view of the product container, the adapter, the support, and the chamber.
Figure 15:
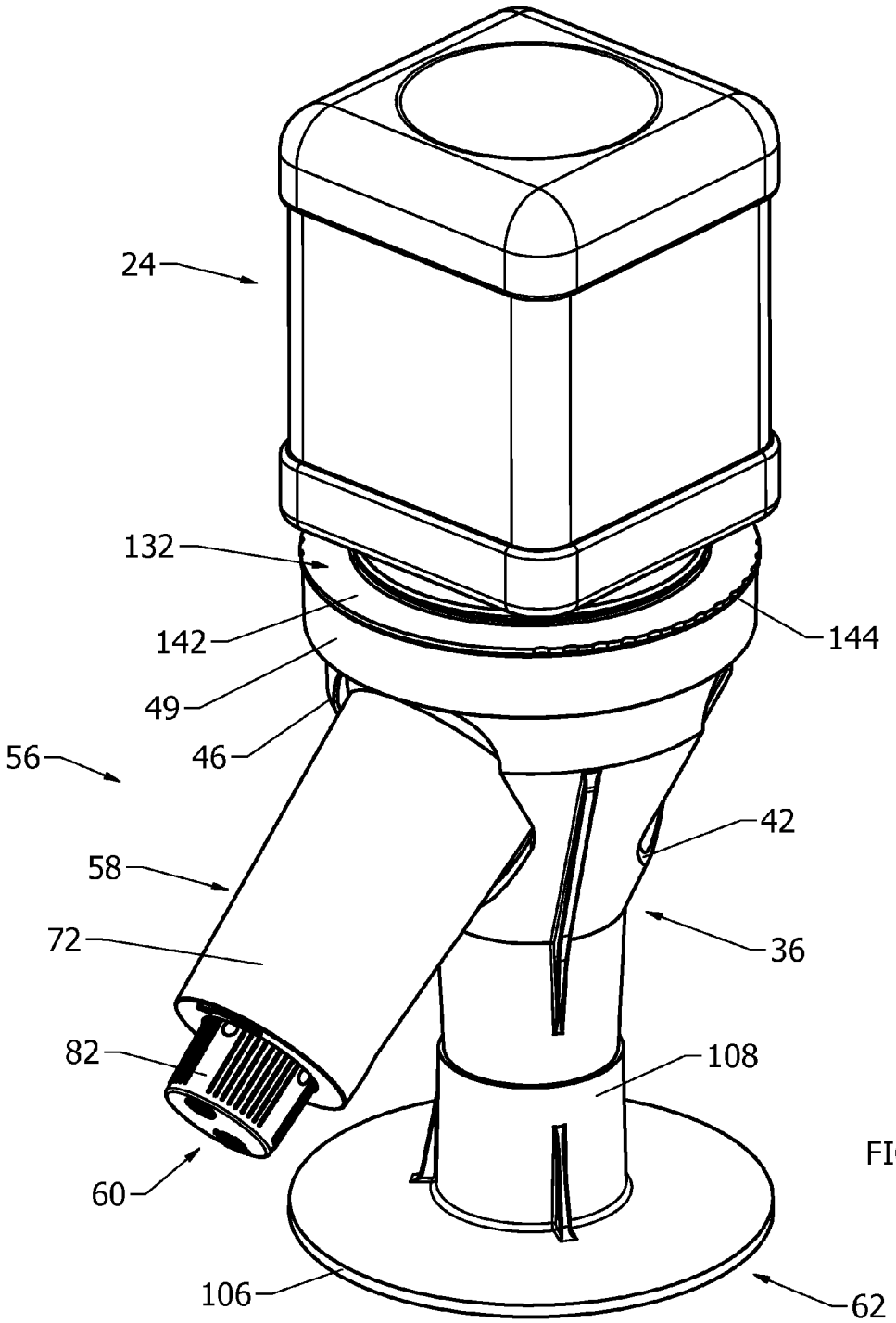
FIG. 15 is a perspective view of the product container and adapter secured to the support and the chamber.

Referring now to FIGS. 13-15, an adapter 132 is shown having an outer mounting surface 134 with threaded portion 136. The adapter 132 also includes an inner mounting surface 138 having a threaded portion 140. A top surface 142 may also include a knurled surface 144 to assist with securing the adapter on the dispenser. In operation, adapter 132 is useful to permit a smaller diameter neck 26 on container 24 to be used with dispenser 56. The adapter 132 may be secured directly to a smaller container 24 and then the container and adapter 132 may be secured to dispenser 56 in a fashion similar to operations where only container 24 is utilized. Further, adapter 132 may be secured directly to dispenser 56 and then container 24 may be secured to adapter 132. Specifically, adapter outer mounting surface 134 and threaded portion 136 are threaded into dispensing device 56 at neck 49 and first mounting thread 52 or second mounting thread 54 as may be appropriate. Next, container 24 is treaded into inner mounting surface 138 with threaded portion 140 engaging container threaded portion 28. The adapter is useful to secure containers having a neck diameter capable of receiving lids having an 89 mm diameter instead of the more traditional 110 mm lid, although any suitable container neck diameter is within the spirit and scope of the present disclosure. Accordingly, adapter 132 permits dispenser 56 to be used with a number of different container sizes, thereby reducing consumer frustration and the expense of having multiple dispensers.

Figure 16:
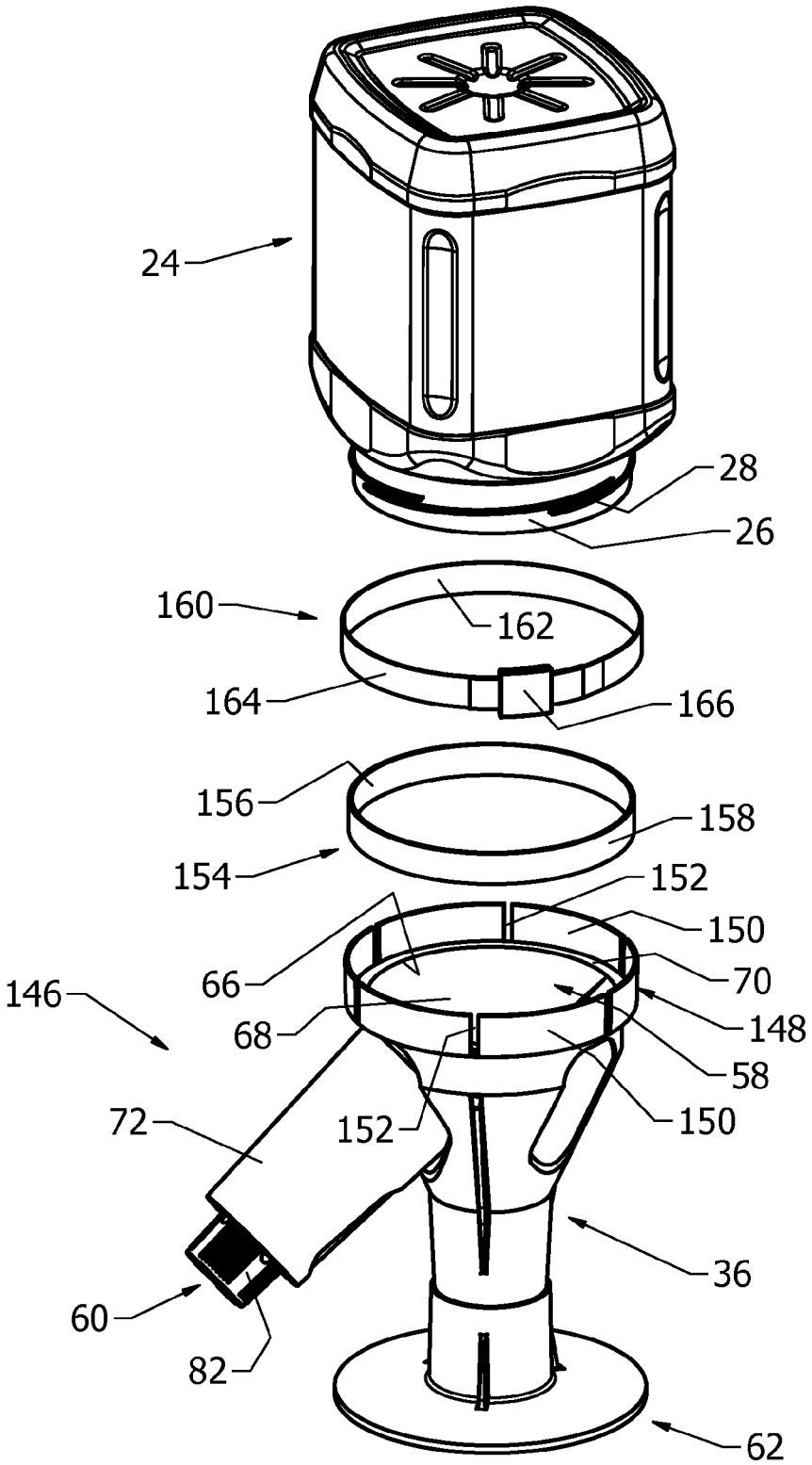
FIG. 16 is a perspective exploded view of a support, a chamber, a mounting ring, a clamping device, and a product container.
Figure 17:
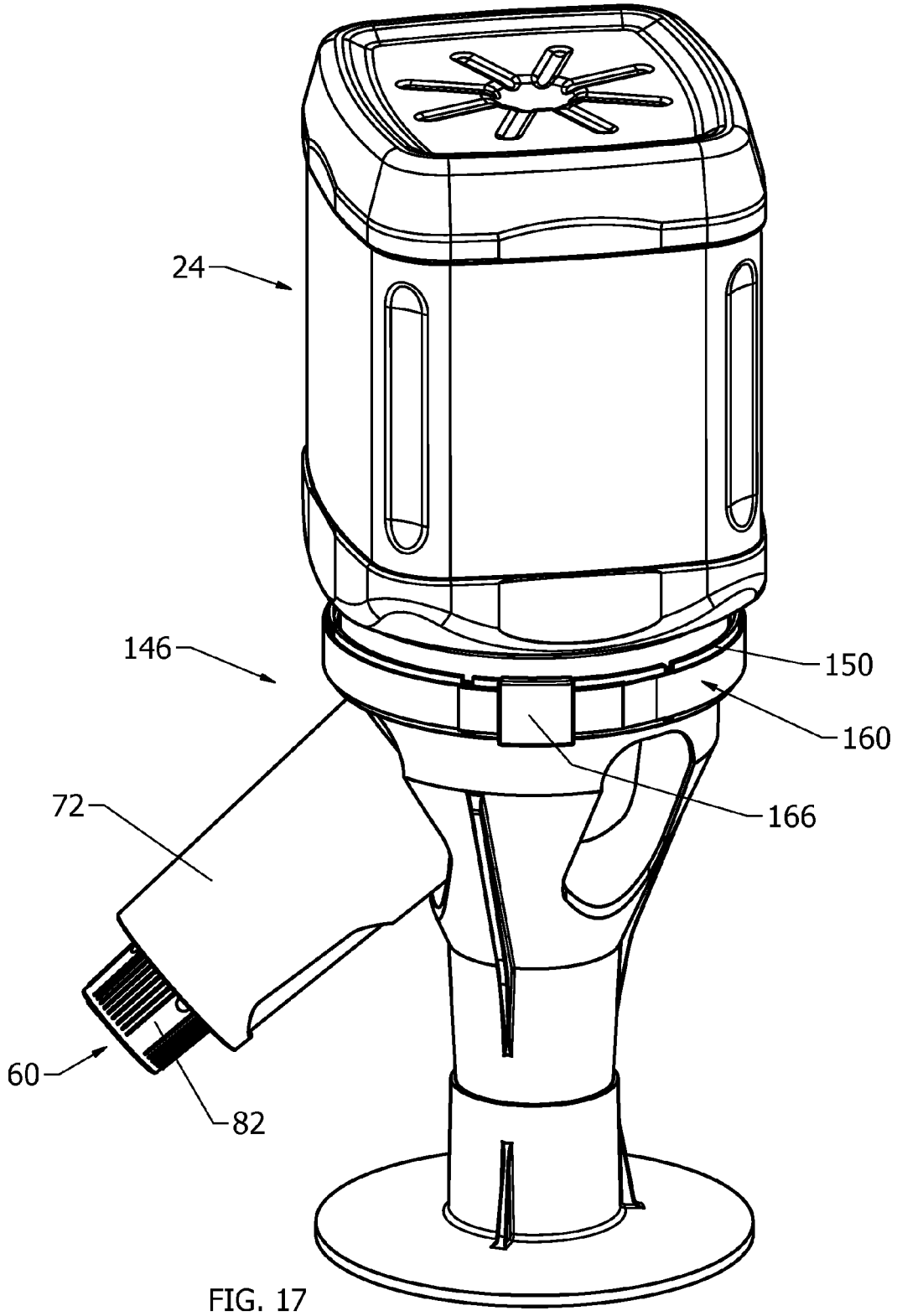
FIG. 17 is a perspective view of the mounting ring and clamping device securing the product container to the support.
Figure 18:
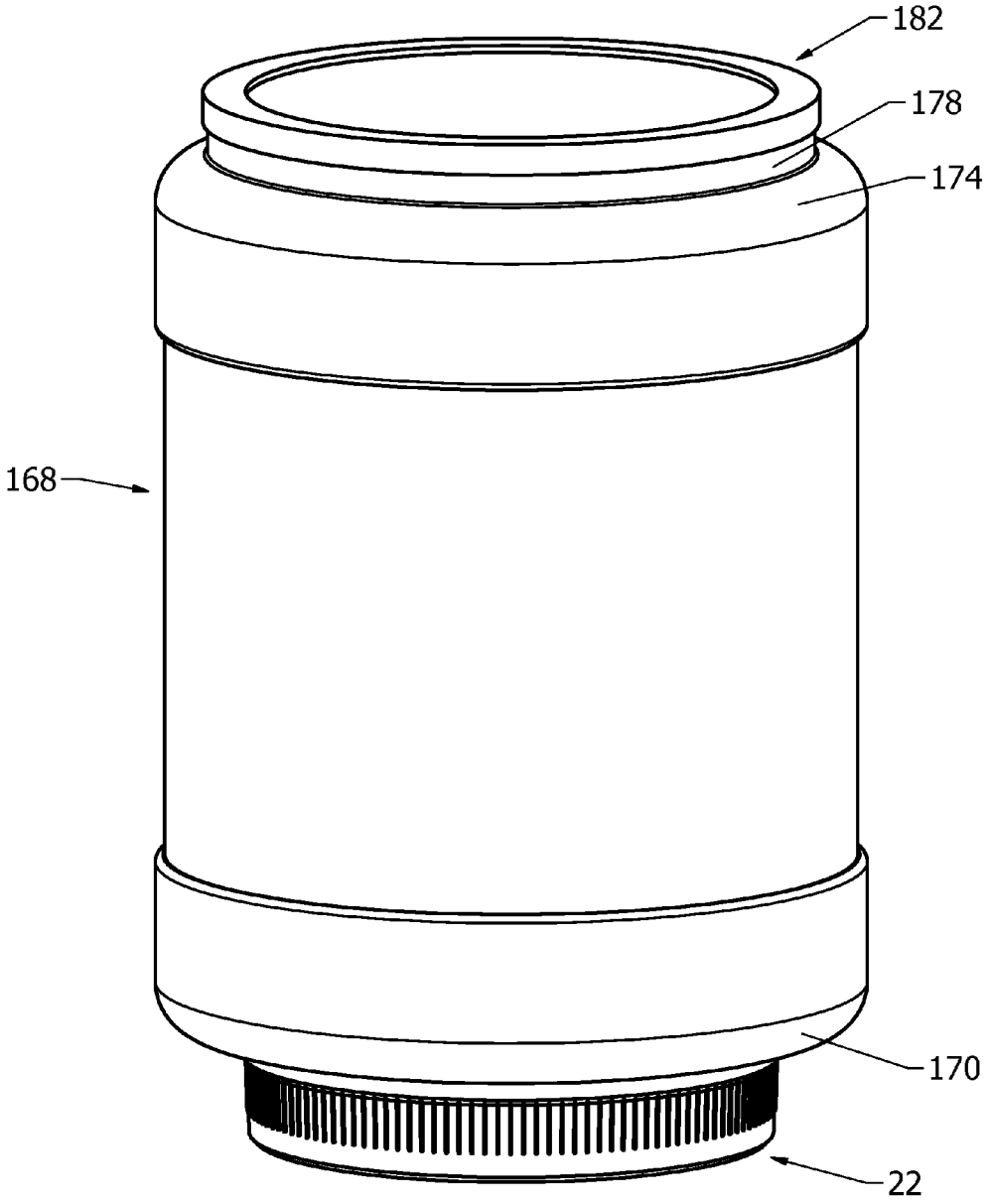
FIG. 18 is a perspective view of a product container having two lids.
Figure 19:
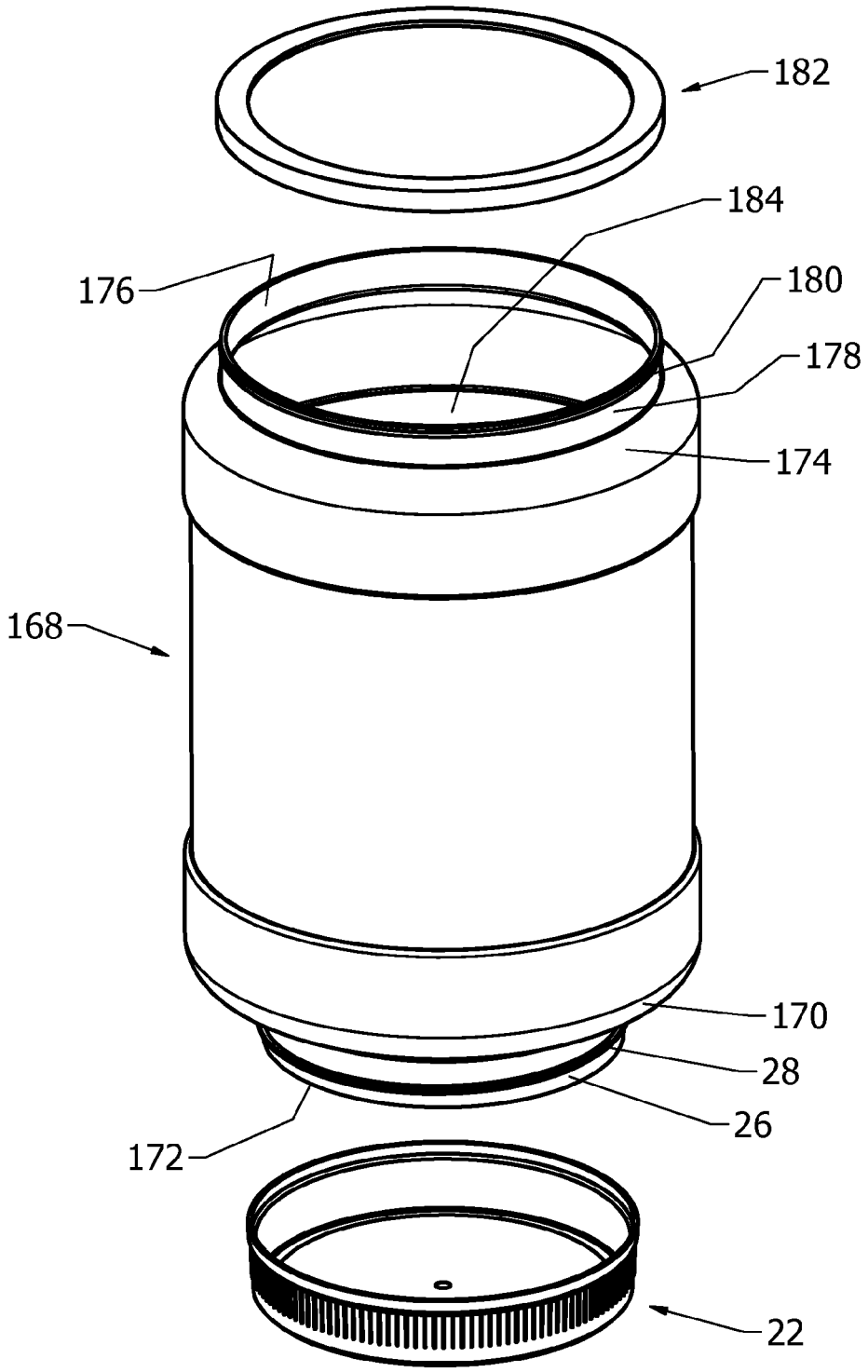
FIG. 19 is a perspective view of the product container having two lids with both lids removed.
Figure 20:
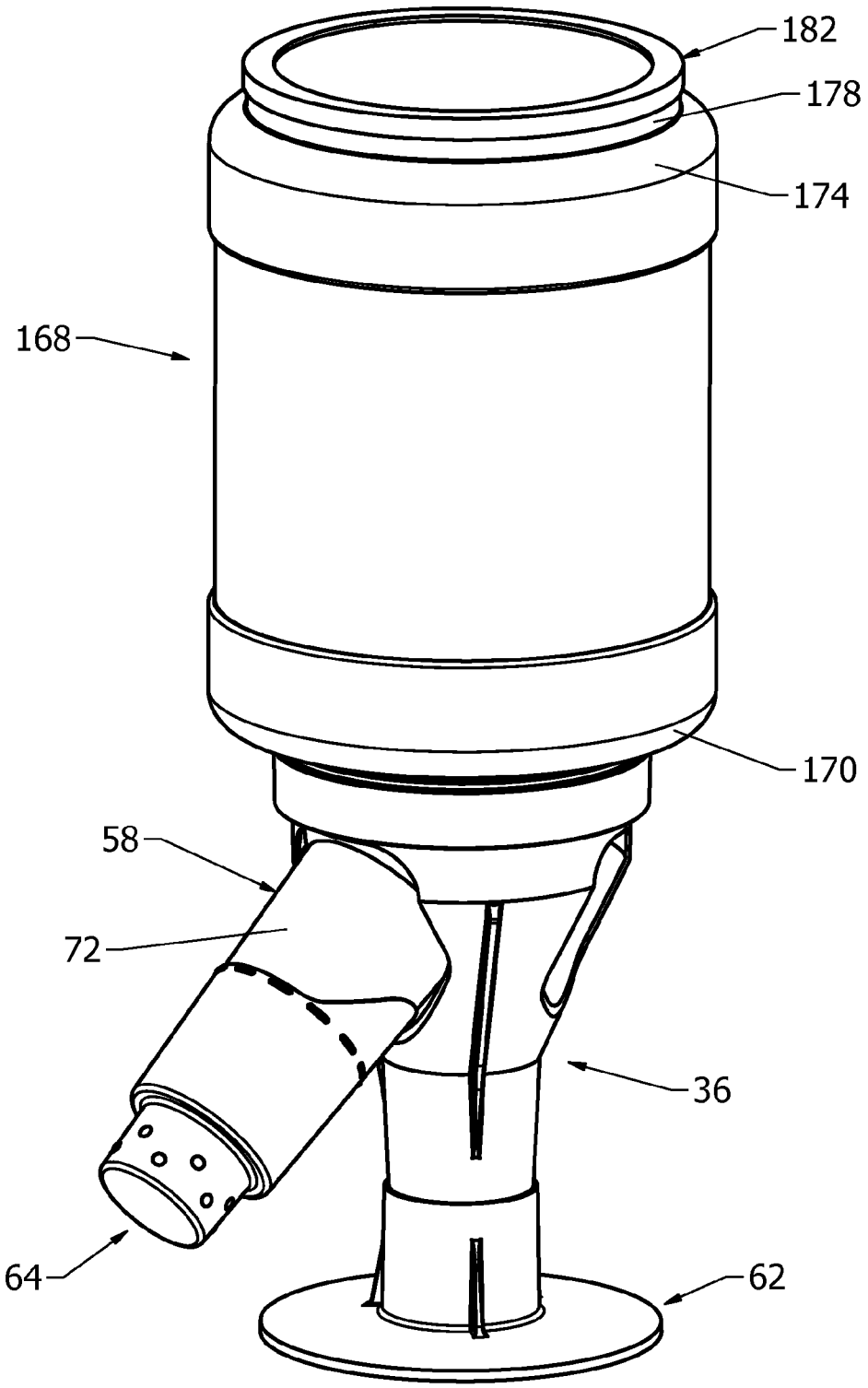
FIG. 20 is a perspective view of the product container having two lids and secured to the support.

Referring now to FIGS. 16 and 17, a second aspect container connecting device and method is illustrated. Dispenser 146 is similar to dispenser 56 and includes support 36 having chamber 58, dial 60, and spout 72. Lip 70, cavity 66, and cavity inner surface 68 are again similar to dispenser 56. A neck 148 extends upwards and replaces neck 49 with a plurality of flexible flanges 150 with gaps 152 there between to further encourage flexibility for each flexible flange 150. A mounting ring 154 includes an inner surface 156 and an outer surface 158 and may be composed of a rubber, plastic or any other suitable material which functions to seal the container 24 to dispenser 146. Still further, a clamping ring 160 may include an inner surface 162, an outer surface 164, and a tightening component 166. Clamping ring 160 may be composed of a metal, hard plastic, or any other suitable material and tightening component 166 may be a ratcheting mechanism, a sliding mechanism, a folding mechanism or any other suitable securing mechanism. In operation, mounting ring 154 is positioned either around neck 26 or within flexible flanges 150 so that container 24 may be positioned within mounting ring 154 and tightening component 166 may be secured around flexible flanges 150 and tightened to compress mounting ring 154 and flexible flanges securely around neck 26, thereby securing container 24 to dispenser 146 without requiring threaded portion 28 on the container. Still further, mounting ring 154 may be positioned radially outside of flexible flanges 150 such that tightening component 166 directly contacts mounting ring 154 which biases flexible flanges 150 into neck 26 of container 24 to secure container 24 to dispenser 146. Although the mounting ring, flexible flanges, and tightening component are shown and described as circular, any suitable shape may be utilized for these components or any other components described herein. Further, any other suitable compression based arrangements may be utilized to secure the container to the dispenser without departing from the spirit and scope of the disclosure.

FIGS. 18 through 21 illustrate a container 168 having a first end 170 with a first opening 172 therein and a second end 174 having a second opening 176 therein. First end 170 may include neck 26 having threaded portion 28 similar to container 24. Second end 174 includes a neck 178 having a mounting ring 180 for securing lid 182 on neck 178 when a product is within interior cavity 184. As can be seen, first end 170 is arranged and sized similar to the open end of container 24 and is preferably capable of being threadably secured to dispenser 56 as particularly seen in FIG. 20. However, lid 182 may be both larger and include a different removable lid which is capable of connecting to container 168. Thus, container 168 may be easily refillable without disconnecting container 168 from dispenser 56.

Figure 21:
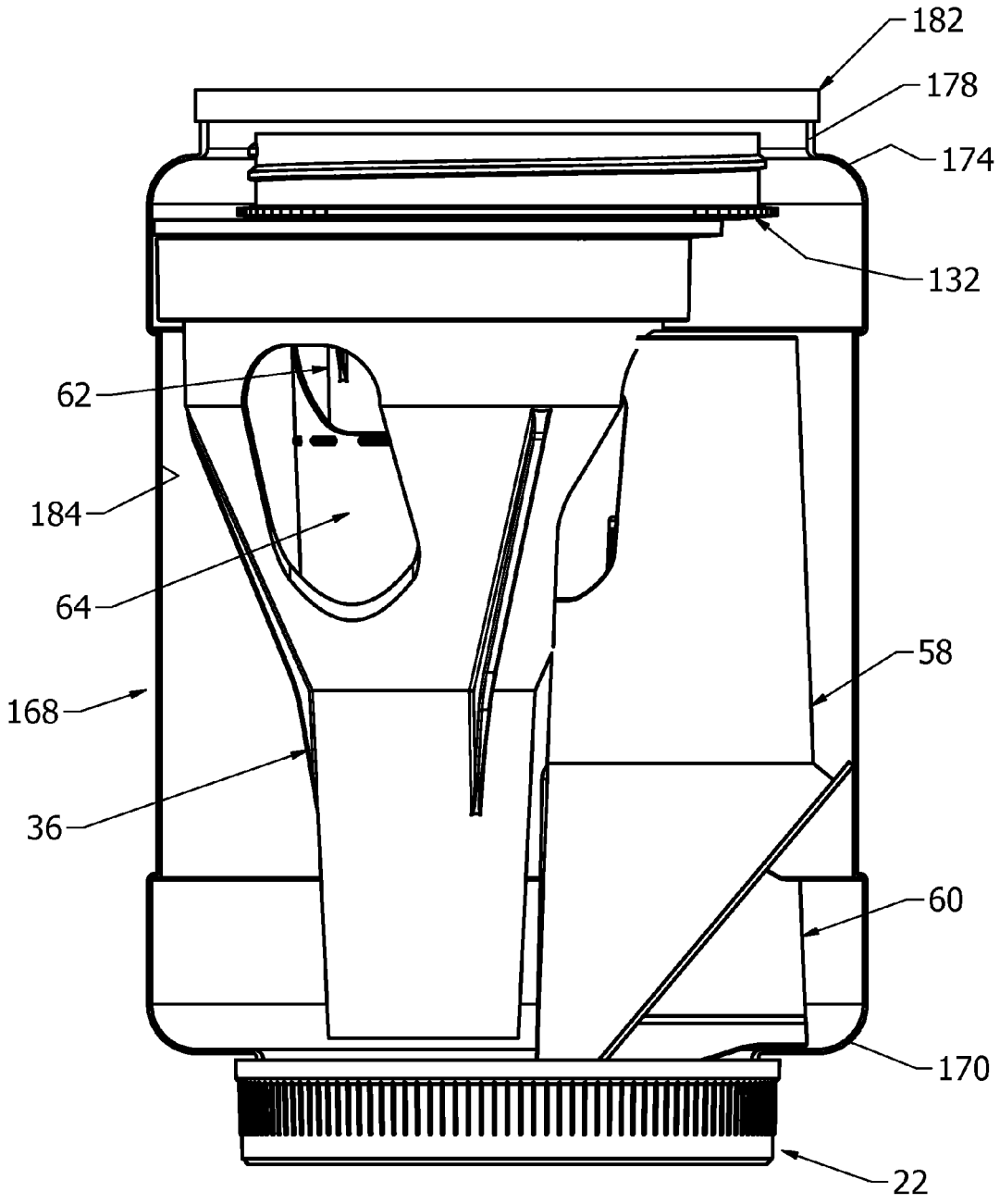
FIG. 21 is a sectional view of the product container having two lids with the support, the chamber, the base, the adapter, and the cap positioned within the product container.

An additional feature of container 168 can be seen in FIG. 21, which is a partial sectional view, with support 36, chamber 58, dial 60, base 62, cap 64, and adapter 132 all secured within the container. Specifically, many of the components are sized such that they mate with first end 170, but are sufficiently small enough to fit through larger second end 174 and second end opening 176. Further, by packaging all of the dispenser pieces and components within container 168, the overall product packaging is cleaner, more efficient, and functions to provide a reusable container for the dispenser. Container 168 is further proven to be beneficial for soft product packaging which does not include a rigid container or include a container which is otherwise incompatible with dispenser 56. In this situation, the user simply removes lid 182, pours the product into interior cavity 184, and may then operate dispenser 56 in the same manner as discussed above. Accordingly, it is seen that a number of advantages are achieved with container 168 from both a packaging perspective and a product dispensing perspective. Nevertheless, a number of changes may be made, including the size, shape, and dimensions of the various components without departing from the spirit and scope of the present disclosure.

It will be understood that implementations are not limited to the specific components disclosed herein, as virtually any components consistent with the intended operation of a method and/or system implementation for a product dispenser may be utilized. Components may comprise any shape, size, style, type, model, version, class, grade, measurement, concentration, material, weight, quantity, and/or the like consistent with the intended operation of a method and/or system implementation for a product dispenser.

The concepts disclosed herein are not limited to the specific implementations shown herein. For example, it is specifically contemplated that the components included in a particular implementation of a product dispenser may be formed of any of many different types of materials or combinations that can readily be formed into shaped objects and that are consistent with the intended operation of a product dispenser. For example, the components may be formed of: rubbers (synthetic and/or natural) and/or other like materials; polymers and/or other like materials; plastics, and/or other like materials; composites and/or other like materials; metals and/or other like materials; alloys and/or other like materials; and/or any combination of the foregoing.

Furthermore, embodiments of the product dispenser may be manufactured separately and then assembled together, or any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular implementations of a product dispenser, it should be readily apparent that a number of modifications may be made without departing from the spirit thereof and that these implementations may be applied to other product dispensers. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

We claim:

1. A dispenser comprising:

a chamber having a cavity and a longitudinal axis;

a spout in communication with the cavity and having an inner surface and oriented non-perpendicular to the longitudinal axis;

a rotatable dial in communication with the spout and having an outer surface, wherein the dial is positioned at least partially within the spout and rotates coaxially with the spout for dispensing a product within the cavity, wherein the dial includes an irregular portion on a first end and wherein the first end is positioned at least partially within the spout; and, wherein the first end includes an agitator which selectively extends into the cavity when the dial is rotated.

2. The dispenser of claim 1 wherein the agitator agitates the product within the cavity when the dial is rotated to an open position.

3. The dispenser of claim 1 wherein the chamber is funnel shaped with a narrower portion adjacent the spout.

4. The dispenser of claim 1 wherein the spout further comprises an aperture and the dial further comprises an aperture.

5. The dispenser of claim 4 wherein the dial aperture and spout aperture are selectively aligned to dispense the product.

6. The dispenser of claim 1 wherein the spout is positioned at an angle with respect to the chamber.

7. The dispenser of claim 1 wherein the dial is positioned at least partially within the spout.

8. The dispenser of claim 1 wherein the dial further comprises at least one protrusion and wherein the protrusion limits axial movement in a direction into and out of the spout.

9. The dispenser of claim 1 further comprising a container positioned on the chamber to provide the product.

10. The dispenser of claim 9 wherein the chamber further comprises a sealing lip engaging the container.

11. A dispenser comprising:

a chamber having a cavity;

a spout in communication with the cavity and having an inner surface;

a rotatable dial in communication with the spout and having an outer surface;

a support having a threaded mounting surface having two or more mounting threads with different thread angles; and, wherein the dial is positioned at least partially within the spout and rotates coaxially with the spout for dispensing a product within the cavity.

12. The dispenser of claim 11 wherein the container engages only one of the two or more mounting thread angles.

13. A dispenser comprising:

a chamber having a cavity;

a spout in communication with the cavity and having an inner surface;

a rotatable dial in communication with the spout and having an outer surface, wherein the dial is positioned at least partially within the spout and rotates coaxially with the spout for dispensing a product within the cavity, wherein the dial includes an irregular portion on a first end and wherein the first end is positioned at least partially within the spout; and, wherein the first end includes an agitator which selectively extends into the cavity when the dial is rotated.

14. The dispenser of claim 13 wherein the agitator agitates the product within the cavity when the dial is rotated to an open position.

15. The dispenser of claim 13 wherein the chamber is funnel shaped with a narrower portion adjacent the spout.

16. The dispenser of claim 13 wherein the spout further comprises an aperture and the dial further comprises an aperture.

17. The dispenser of claim 16 wherein the dial aperture and spout aperture are selectively aligned to dispense the product.

18. The dispenser of claim 13 wherein the spout is positioned at an angle with respect to the chamber.

19. The dispenser of claim 13 wherein the dial is positioned at least partially within the spout.

20. The dispenser of claim 13 wherein the dial further comprises at least one protrusion and wherein the protrusion limits axial movement in a direction into and out of the spout.

* * * * *